United States Patent [19]

Wexler et al.

[11] 4,123,062

[45] Oct. 31, 1978

[54] GAME WITH MULTIPLE CHOICE STRATEGY

[75] Inventors: Howard Wexler, New York; Lawrence L. Reiner, Woodbury, both of N.Y.

[73] Assignee: Mego Corp., New York, N.Y.

[21] Appl. No.: 789,860

[22] Filed: Apr. 25, 1977

[51] Int. Cl.[2] ..... A63F 3/00

[52] U.S. Cl. ..... 273/248; 273/243

[58] Field of Search ..... 273/248, 243, 258, 268

[56] References Cited

U.S. PATENT DOCUMENTS

| | | | |
|---|---|---|---|
| 885,588 | 4/1908 | Dehls | 273/243 |
| 1,729,023 | 9/1929 | Andrews | 273/268 |
| 1,903,661 | 4/1933 | Storey | 273/248 |
| 2,343,812 | 3/1944 | Sikora | 273/248 |
| 4,032,152 | 6/1977 | Schifman | 273/258 |

*Primary Examiner*—Richard C. Pinkham
*Assistant Examiner*—Harry G. Strappello
*Attorney, Agent, or Firm*—Bertram Frank

[57] ABSTRACT

A game played by two persons, namely a player and an opponent player. Each player has an equal plurality of playing pieces, and each player has alternate turns at manipulating a plurality of discrete identification elements bearing symbols, e.g. a pair of dice, and continuing his turn as long as the symbols can be used, either separately or in combination, to move his or his opponent's playing pieces on a playing board in correspondence to the symbols on the identification elements. The object of the game is to get all the playing pieces of the player or opponent player into certain positions on the playing board, and the multiple choice strategy entails a player moving his own playing pieces either towards the preestablished finish position or positions, or moving his opponent player's pieces back from a final position or positions. The multiple choice strategy evolves from the novel method of steps and alternate choice involved in the game. Structure for the game as an article of manufacture is also disclosed. The present game is a synergistic combination of concepts which combine both the elements of chance and judgment, with the element of chance arising from the random orientation, after manipulation, of the discrete identification means to register identifying symbols, e.g. the tossing or rolling of a pair of dice.

35 Claims, 5 Drawing Figures

GAME WITH MULTIPLE CHOICE STRATEGY

BACKGROUND OF THE INVENTION

1. Field of the Invention

A game with multiple choice strategy.

2. Description of the Prior Art

Certain games of minimal complexity having a multiple choice strategy are widely known. Such games include backgammon and checkers. These games have relatively simple rules and the challenge to the judgment of the players is limited. In addition, the element of chance does not come into play in such games as checkers, chess and the like, since the moves of the playing pieces are entirely governed by the choice and judgment of the players. Perhaps the most widely known game which combines both the elements of chance and judgment is MONOPOLY, however this game is relatively lengthly and time-consuming to play to a finish, and thus the pleasure and satisfaction of winining, or the frustration of losing, does not recur frequently in the game of MONOPOLY and thus the game is only of interest primarily to juveniles because of the simulated illusion of owning property and collecting rents, and/or of owning a large quantity of play money.

SUMMARY OF THE INVENTION

1. Purposes of the Invention

It is an object of the present invention to provide a new game for the enjoyment and pleasure of people.

Another object is to provide a game which is simple enough for a child to play, yet stimulating enough for adults.

A further object is to provide a new game with multiple choice strategy.

An additional object is to provide a new game which combines both the elements of chance and judgment.

Still another object is to provide a new game in which completion of the game, or a win, does not require an inordinate length of time.

These and other objects and advantages of the present invention will become evident from the description which follows.

2. Brief Description of the Invention

In the present invention, a game having multiple choice strategy for a player and an opponent player is provided. The player and his opponent player have alternate turns to play. A playing board of novel configuration, a plurality of playing pieces, and a plurality of discrete identification means bearing identifying symbols, e.g. a pair of dice, are provided. The playing pieces are moved, i.e. manipulated, in a series of steps or stages in accordance with the pre-determined rules of the game. The total plurality of playing pieces is equally divided into a first plurality of playing pieces and a second plurality of playing pieces, i.e. the number of playing pieces in the first and second pluralities of playing pieces are equal. The first plurality of playing pieces primarily relates to the player and the second plurality of playing pieces primarily relates to the opponent player, with the objective of each player in the game being to suitably dispose his own pieces in a certain position or positions so as to win the game. Each of the playing pieces in the first and second plurality of playing pieces relates to a distinct identifying symbol, and each identifying symbol of one of the first plurality of playing pieces is the same as the identifying symbol of one of the second plurality of playing pieces.

The method of the game of the present invention essentially entails disposing each of the playing pieces at a location on the playing board separate and different from the balance of the playing pieces. This location for each playing piece, during steady state play of the game, can be either a start position, a vulnerable intermediate position to which the playing piece has been moved from the start position, or a non-vulnerable finish position to which the playing piece has been moved from the intermediate position.

The player and the opponent player, in alternate turn, concomitantly manipulate a plurality of discrete identification means bearing identifying symbols, such as, typically, a pair of dice. As is well known, dice consist of six-sided regular rectangular parallelepipeds in which each side of each dice bears the marking of at least one dot, with the number of dots on each side being from one to six, and with no two sides bearing the same number of dots, i.e. in a preferred embodiment the plurality of identifying symbols are all different from each other for each discrete identification means. A first manipulation of the plurality of identification means is by the player and a second manipulation of the plurality of identification means is by the opponent player, i.e. each player takes alternate turns at manipulating the plurality of identification means.

Each of the manipulations serve to register a plurality of the identifying symbols, i.e. one symbol is registered for each of the plurality of identification means. In the case of dice, the dice are tossed and rolled, and come to rest with one face upwards. In this case, the upwards horizontal face bears a certain number of dots which represent a registered symbol, namely a number from one to six. The first player, who has performed the first manipulation of the identification means, then displaces, after the first manipulation and in correspondence to the symbols registered either on each or the combination of at least two identification means, at least one (especially in the case of utilizing the combination), or a plurality, of the first plurality of playing pieces either from starting position or finish position to intermediate position, or at least one of the second plurality of playing pieces from intermediate position to start position. Such displacement of playing pieces in each instance must correspond exactly to all of the registered symbols, no more and no less, and either separately or in combination. For example, if a pair of dice are manipulated, and a three and a five are registered, either a playing piece corresponding to a three and a playing piece corresponding to a five, or a single playing piece corresponding to eight, are displaced by the player.

The player continues his turn and manipulates the plurality of identification means with corresponding displacement of playing pieces, until movement of a playing piece corresponding to each separate one or the combination of a plurality of registered identifying symbols is no longer possible.

The strategy of the game and the ultimate objective of each player is to advance his own playing pieces to a winning position. Thus the player will endeavor to displace his own playing pieces forwards, typically from start position to intermediate position, and to displace the opponent player's playing pieces backwards from intermediate position to start position, the displacements or movement of such playing pieces being entirely dependent on the identifying symbols which happen to be registered on the identification means. As a last resort, and in order to keep his turn at manipulating the identification means, based on the absolute rule that all of the registered symbols must be used for moves of playing pieces either individually or based on a combination of registered symbols, the player may choose to displace one or more of his own playing pieces from finish position to intermediate position. It will be understood that only the player, and not the opponent player, can displace his own playing pieces in this manner. Such a displacement is of course divergent and opposite to the objective of the game, and entails a calculated risk that the next manipulation of the identification means will be more favorable to the player. Thus the elements of chance as well as judgment are highly important in the game.

Thereafter, after movement of a playing piece or pieces by the player corresponding to each separate one or the combination of a plurality of registered identifying symbols is no longer possible, the player relinquishes his turn and the opponent player moves all of the second plurality of playing pieces (his own) which may be in intermediate position to finish position. Thus these opponent player pieces, now in finish position, become safe from attack by the player, and the player can no longer move them back to start position. As discussed supra, only the opponent player can, if he so chooses, move such of his playing pieces which are in finish position back to intermediate position, which would be done in order for the opponent player to keep his turn.

Thereafter, the second (opponent) player now has his turn and displaces, after his (the second) manipulation of the plurality of identification means, and in correspondence to the symbols thereafter registered on each or the combination of at least two identification means, at least one of the second plurality of playing pieces (his own) either from its start position or its finish position to its intermediate position, or at least one of the first plurality of playing pieces from its intermediate position to its start position. The opponent player continues his turn and further manipulates the plurality of identification means, e.g. continues tossing and rolling a pair of dice, until movement of a playing piece corresponding to each separate one or the combination of a plurality of registered identifying symbols is no longer possible.

Thereafter, the player takes his turn, and first moves all of the first plurality of playing pieces (his own) in intermediate position to finish (safety) position. Then the player resumes manipulation of the identification means and corresponding displacement (movement) of playing pieces.

In general, manipulation of the plurality of identification means alternately by the player and the opponent player continues until either the first plurality of playing pieces or the second plurality of playing pieces is entirely disposed away from their start position. When this is accomplished, whoever has succeeded to do so is declared the winner of the game.

Further play of the game by the player and opponent player may be resumed simply by displacing all of the playing pieces back to their start positions. In other words, the game is preferably initiated with all of the playing pieces in start position. In an alternative embodiment, the game may be initiated with all of the playing pieces in intermediate position, in which case the objective of a player of the game would be to displace all of his own playing pieces (those relating to him) to the finish position. In this case, the rules would have to be slightly altered to accommodate for the fact that all of the playing pieces are initially in intermediate position, i.e. movement of playing pieces to finish position from intermediate position would not take place until a pre-determined number of turns has elapsed.

Typically when the game is won, the final disposition of the winner's plurality of playing pieces, which are all away from start position, is a portion in intermediate position and the balance in finish position. In an alternative and longer version of the game, the final disposition of the winner's playing pieces, which are all away from starting position, is entirely in finish position.

In a preferred embodiment, each identifying symbol is a number, although alternate individual identifying symbols such as a letter, a color, a visual reproduction such as the representation of a flower, a fruit, a vegetable, an animal, etc., are also contemplated as being within the scope of the present invention. Visual reproductions of various types of flowers are well known to most people. Thus everyone recognizes the rose, the daffodil, the daisy, the lily, the carnation, the tulip, the morning glory, the orchid etc. Similar considerations apply to fruits, vegetables and animals. This is especially true when the visual reproductions or representations are colored. It will thus be appreciated that in the case of flowers, in one embodiment of the invention, one identifying symbol could be a rose, the next one a daffodil, the next one a daisy, etc. Similar considerations apply to fruits, vegetables and animals.

Typically the plurality of identification means will be a plurality of discrete regular polyhedrons, each face of each polyhedron bearing a different one of the identifying symbols. Any reasonable number of such identification means may be concomitantly manipulated in the game, however the preferred number of identification means for purposes of simplicity and avoidance of confusion, and for fast action in the game, is two. As mentioned supra, the identification means preferably consists of a pair of dice (in which case the identifying symbols will be numbers), however more than two dice, such as three or even four or five of them, may be concomitantly manipulated.

Typically, such as e.g. when each identifying symbol is a number, in a preferred embodiment the number of playing pieces in each of the first and second plurality of playing pieces is ten, and the distinct identifying symbol for each playing pieces is a number from one to ten. Preferably, each one of such numbers will differ from the balance of the numbers in each plurality of playing pieces, and each one of such numbers will be present once (for one playing piece) in each plurality of playing pieces.

The present game provides several salient advantages. A principal advantage is that the game is exciting and challenging to play, since it combines both the elements of chance and judgment, due to the multiple choice strategy involved in the game as well as the random manipulation of the identification means, e.g. the tossing or rolling of a pair of dice. Thus the present game provides a great deal of enjoyment and pleasure to people, since it is an exciting, fast action game, wherein both luck (chance) and mental exercise of judgment play a part in the playing of the game. The present game is simple enough for a child to play, yet it is stimulating enough for adults. The game is reasonably rapidly played to a conclusion, i.e. a win, since the players soon become apprised of the elements of risk and judgment demanded by a proper and best multiple choice strategy for playing the game, and thus the play of the game is not boring since a conclusion, i.e. a win, is reached fairly rapidly in most instances, except when two experienced players are evenly matched, in which case the game is a see-saw battle which is challenging and requires utmost attention and concentration to prevail. Thus, the game provides a satisfactory diversion from the worries and cares of the everyday world, and serves to generate some harmless excitement and interest in people's lives. The game may of course be used as a vehicle for wagering on the outcome, in which case the excitement, interest and pleasure of the players is even further enhanced. This is further reinforced by the fact that completion of the game, or a win, does not require an inordinate length of time.

The invention accordingly consists in the features of construction, combination of elements, arrangement of parts and series of steps which will be exemplified in the method and article of manufacture hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
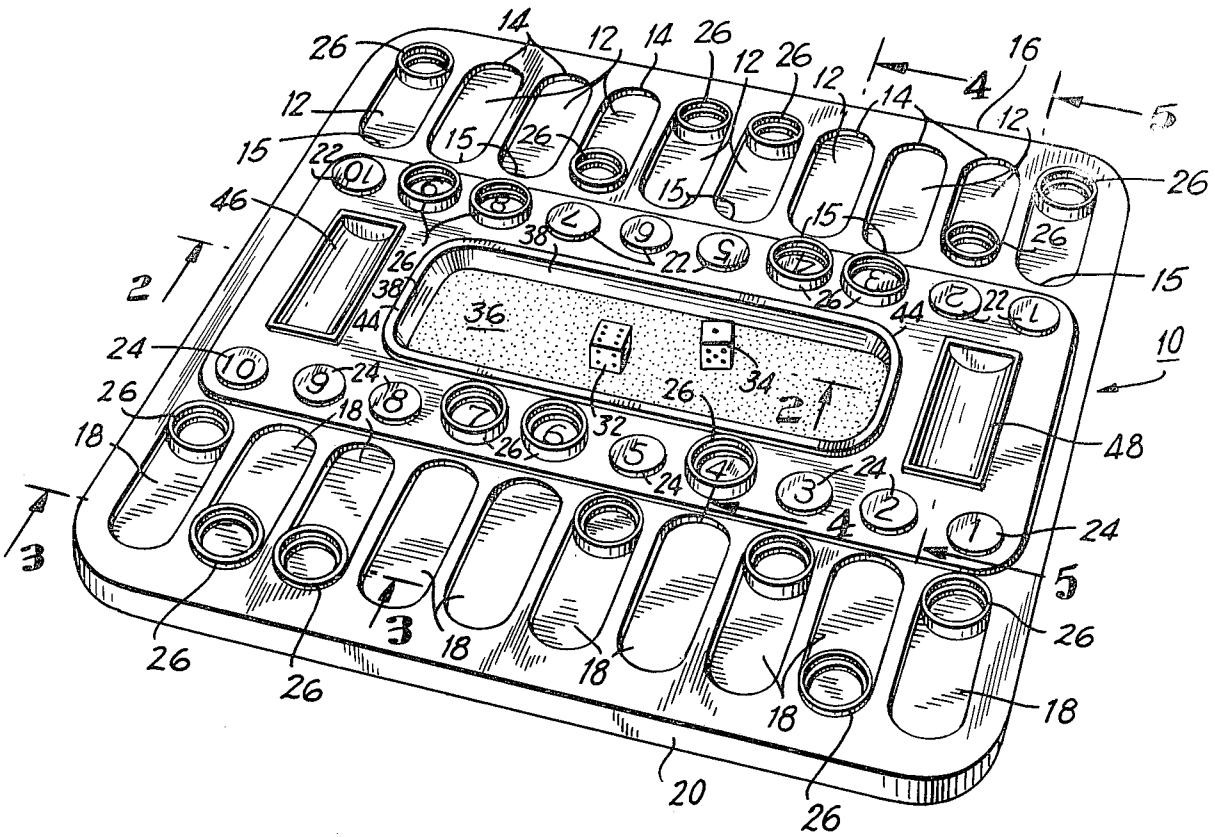
FIG. 1 is a perspective view of a typical playing board with appurtenances therein and thereon.
Figure 2:
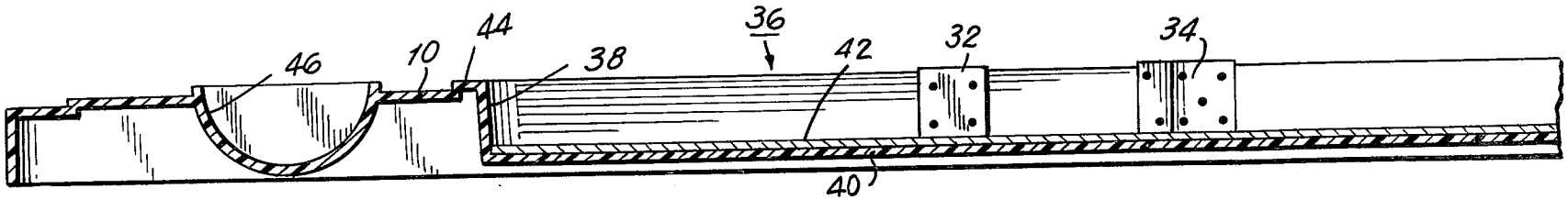
FIG. 2 is a sectional elevation view taken substantially along the line 2—2 of FIG. 1.

Basically the structure of the present game as an article of manufacture and as shown in FIGS. 1–5 is, in general terms, that of a game, with multiple choice strategy for a player and an opponent player having alternate turns to play, in which the game is played on a flat planar playing board 10. The board 10 as shown is preferably substantially rectangular, and in most instances the board 10 will be square. The board 10 in this embodiment of the invention is composed of plastic, however other alternative suitable materials of construction such as wood or cardboard may be employed in suitable instances.

A first plurality of linear channels 12 of substantially identical configuration are provided on the board, and as shown the channels 12 are slots formed as linear depressions below the surface of the playing board 12. The channels 12 consist essentially of discrete slide spaces on the surface of the board 10, and the channels 12 are juxtaposed in parallel substantially perpendicular to an edge 14 of the board 10. It will be understood that in suitable instances the channels 12 may alternatively merely be marked-off or colored slide spaces on the surface of the board 10, or even slide spaces on the surface of the board 10 which are bordered by peripheral raised lips, baffles or barriers. The linear channels 12 in this embodiment of the invention are provided with terminal rounded or curved outer ends 14 and terminal rounded or curved inner ends 15 to accommodate the preferred circular configuration of the playing pieces, as will appear infra.

A second plurality of linear channels 18 of a configuration comparable to that of the channels 12 is also provided on the surface of the board 10, i.e. the channels 18 are discrete slide spaces preferably in the form of slots formed as linear depressions below the surface of the playing board. The total number of channels 18 is equal to the total number of channels 12, namely ten of each. The channels 18 are juxtaposed in parallel substantially perpendicular to an edge 20 of the board 10, the edge 20 being opposite to the edge 16. As shown, the linear channels 12 and 18 are each of straight line form, i.e. the central longitudinal axis of each linear channel is a straight line. Curved or angular linear channels may alternatively be provided in suitable instances, in which case the concept of the present invention might be practiced in the linear channels per se, with movement of playing pieces not being directly from one end or terminus of a linear channel to the other but instead in stages, e.g. from one end of an angular channel, (typically an angular channel would define an obtuse angle) to the apex of the angular channel, and subsequently to the other end of the angular channel.

A first plurality of discrete means 22 consisting in this case of raised circular protuberances above the surface of the playing board 10 are provided. The first plurality of means 22 thus are on the surface of the board 10 and each of the means 22 is juxtaposed with the inner end of one of the first plurality of channels 12. Thus the first plurality of discrete means 22 designate first finish positions, i.e. the finish or safety position for the playing pieces of the player who is stationed at edge 16. Each of the discrete means 22 is furnished with a visual number from one to ten; in this embodiment of the invention each of such numbers is different from all of the other numbers. The visual numbers on the discrete means 22 each constitute a distinct identifying symbol which relates to a specific one of the channels 12 and its associated discrete means 22. It will be appreciated that the visual numbers which are shown on the means 22 may alternatively be disposed on the board at or adjacent to one end of a linear channel 12, or even in a linear channel 12. Similar considerations apply to the alternative other types of recognizable and distinct identifying symbols mentioned supra.

A second plurality of discrete means 24 comparable in configuration and function to means 22 is disposed on the surface of the playing board 10. Each of the means 24 is juxtaposed with the inner end of one of the second plurality of channels 18, and the means 24 represent the finish or safety position for the playing pieces of the opponent player who is stationed at edge 20.

The playing board 10 of the game is completed in its broadest embodiment by the provision of a plurality of movable playing pieces 26. As shown, the game is in progress and each one of the playing pieces 26 is associated with one of the channels (slots) 12 or 18 and its associated discrete means (raised protuberances) 22 or 24, i.e. each playing piece 26 is disposed either at the outer end 14 of a slot 12 (or the outer end of a slot 18); at the inner end 15 of a slot 12 (or the inner end of a slot 18); or at a discrete means (raised protuberance 22 or 24) associated with one of the channels 12 or 18. Thus in effect, each playing piece 26 relates to one of the numbers from one to ten which are visually shown on the discrete means 22 or 24. However it will be appreciated that in practice, the playing pieces 26 per se may alternatively or additionally also be provided with distinct identifying symbols, in which case the symbols on the discrete means 22 or 24 may be dispensed with, at the discretion of the particular toy designer who specifies the game for manufacture.

Figure 3:
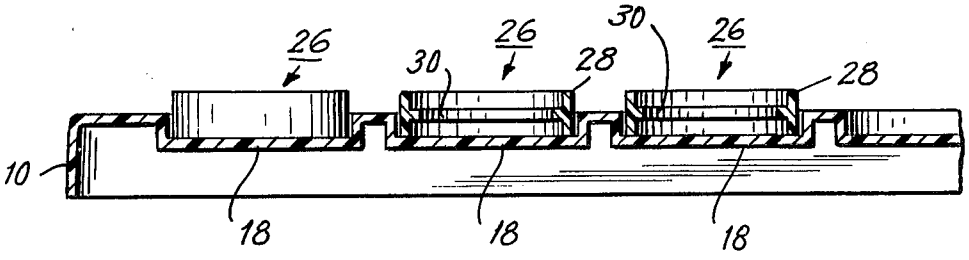
FIG. 3 is a sectional elevation view taken substantially along the line 3—3 of FIG. 1.
Figure 4:
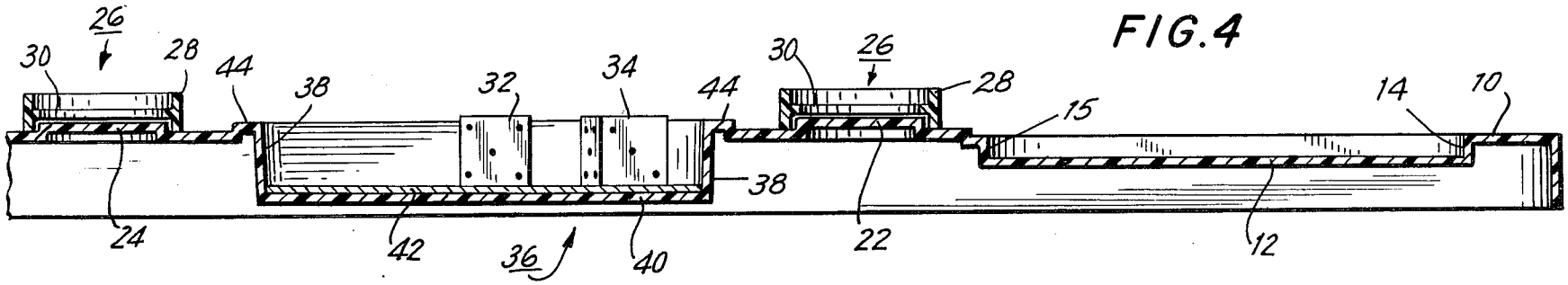
FIg. 4 is a sectional elevation view taken substantially along the line 4—4 of FIG. 1.
Figure 5:
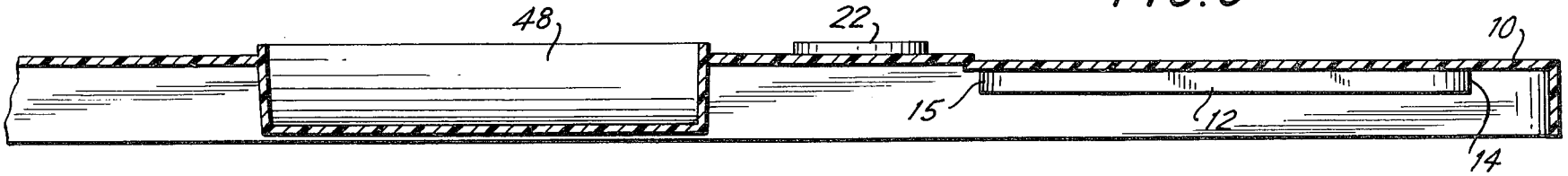
FIG. 5 is a sectional elevation view taken substantially along the line 5—5 of FIG. 1.

As best shown in FIG. 1, each playing piece 26 in this embodiment of the invention is of generally flat cylindrical configuration, i.e. each playing piece 26 is generally ring shaped with a circular perimeter. Other suitable configurations for the playing pieces 26, such as disc-shaped, rectangular e.g. square, elliptical, or triangular may be provided in practice. As best shown in FIGS. 3 and 4, each playing piece 26 in this embodiment of the invention is provided with an annular cylindrical section 28 an an inner lip 30 which is disposed around the inner perimeter of the section 28. Thus, as best shown in FIG. 4, the lip 30 in combination with the lower portion of the section 28 serves to define a recess, which recess mates with the raised disc-shaped protuberance 22 or 24 when a playing piece 26 is in finish or safety position, so that in this case the playing piece 26 is firmly emplaced and cannot be slid on the surface of the playing board 10 but instead must be lifted off of the protuberance 22 or 24 in order to be displaced. Thus the clear simulation of a safety zone or position is attained in this preferred embodiment of the invention. It will be appreciated that as an alternative to a discrete lip of limited extent, a central disc-shaped baffle portion may be provided for each playing piece 26, which baffle portion would extend across and around the inner perimeter of section 28. Other suitable alternative configurations for the playing pieces 26 will occur to those skilled in the art.

The game is completed in its broadest embodiment by the provision of a plurality of discrete identification means bearing identifying symbols and which are capable of being manipulated. Such discrete identification means are preferably a plurality of equal sized regular polyhedrons, each face of each polyhedron bearing a different one of the identifying symbols. Other feasible identification means could be a wheel or wheels bearing the identifying symbols in spaced apart annular disposition, e.g. a roulette wheel, with the wheel being spun and suitable means such as a ball or a projecting pin indicating the randomly selected identifying symbol. In the preferred embodiment of the game as shown in the FIGS. 1, 2 and 4, the plurality of discrete identification means is a pair of dice 32 and 34, and the dice 32 and 34 are disposed in a centrally located area 36 on the playing board. The area 36 is preferably provided integrally with the playing board 10 and on its surface in order to furnish an area for random movement of the discrete identification means, i.e. the tossing and rolling of the dice 32 and 34. The area 36 in most instances and as shown (FIG. 1) is spaced between the first plurality of channels 12 and the second plurality of channels 18, and is typically of generally rectangular configuration. The area 36 is preferably centrally disposed on the playing board 10, and preferably a central recess in the surface of board 10, which recess is defined by peripheral vertical or downwardly sloping edges or walls 38 and a bottom floor 40, on which is typically disposed a layer of felt 42. Other suitable soft and resilient materials such as padding, foamed plastic, rubber or the like may alternatively be furnished instead of the layer or mat 42 of felt, or the central recess 36 may even be devoid of a covering or upper layer of soft felt-like material, in the interest of economy of production cost and consequent selling price of the game.

In forming the playing board 10 from plastic or a metal such as aluminum, a sheet of material is stamped and/or formed in a press from a single flat layer into a suitable and desired physical configuration for the board 10. Thus various appurtenances may additionally be formed in situ during the forming of the single sheet. One such appurtenance is a raised ridge 44 formed about the upper periphery of the recess 36 and at the upper edges of the edge walls 38. The ridge 44 performs a useful function in preventing the playing pieces 26 from sliding over the edge of walls 38 and falling to the bottom of recess 36, as well as providing a certain amount of structural integrity and rigidity at the upper joint between edge walls 38 and the balance of playing board 10.

Another such appurtenance is a pair of oppositely spaced hemi-cylindrical recesses 46 and 48 which are disposed in the surface of board 10 and which serve as storage space for stacking the playing pieces 26 when not in use.

Referring now to the disposition of the dice 32 and 34 as shown in FIG. 1, and to further explain the operation of the game when in progress, the dice 32 has six dots showing on its uppermost horizontal face, and the dice 34 has one dot showing on its uppermost horizontal face. Assuming that it was the turn of the player stationed at edge 16, and that he had tossed or rolled the dice in recess 36 to yield this dispositon of the dice, with a six and a one being registered, the player can now apply a multiple choice strategy to the moving or displacement of playing pieces 26. The playing pieces 26 in slots 12 identified by numerals one and six could both be moved from start position at ends 14 of the slots 12 to intermediate position at ends 15 of the slots 12. Alternatively, only the playing piece 26 in slot 12 identified by numeral six could be moved forwards from start (outer) position at end 14 to intermediate (inner) position at end 15, and concomitantly the opponent player's playing piece 26 at the inner end of the slot 18 identified by numeral one and in intermediate (vulnerable) position could be moved backwards to the outer (start) end of the slot 18 identified by numeral one.

Assuming in the alternative that the opponent player stationed at edge 20 had tossed the dice to the disposition shown in FIG. 1, his only feasible move would be to move the player's playing piece disposed in the slot 12 identified by the numeral seven back from intermediate position at end 15 to start position at end 14, since the combination (sum) of the registered amounts six and one on the respective dice 32 and 34 is seven.

To briefly summarize the method and rules of the game in a preferred embodiment, and referring to the specific game as shown in the Figures and as described, the object of the game is to be the first player to get all ten of his rings (playing pieces 26) in either the up position on his slide space, in the safety zone, or any combination of the two positions. The setup for start of the game is that each player places one ring in each of his ten slide spaces at the end closest to him. This is referred to as the down position. The highest roll of the dice determines who will go first.

The play then commences. Player 1 rolls the dice. He must use both dice, either separately or in combined total, and move the ring or rings corresponding to the numbers on the dice from the down position to the up position. For example, should player 1 roll a "4" and a "3", he may move ring #4 and ring #3 to the up position or ring #7 to the up position. The up or intermediate position is the end of the slide space closest to the center of the board.

Player 1 then rolls the dice again. Again he must use both dice, separately or together, provided that he can move the corresponding rings from down to up positions. His turn continues until he is unable to use both dice.

Player 2 now takes a turn. In this regard, vulnerability now enters into the game. This vulnerability amounts to a possibility for player 2, on his turn, to move his opponent's (player 1) rings from the up position to their original down position. When in the up position, a player's rings are called vulnerable.

Player 2 begins by rolling both dice. He may take any of the following moves:

a. Using both dice separately, move two of his corresponding rings to the up position.

b. Using the sum total of both dice, move one ring to the up position.

c. Move one or both of his opponent's (player 1) corresponding rings from the vulnerable up position to the down position.

d. Move one of his rings to the up position and one of his opponent's rings to the down position, if the remaining die corresponds.

He continues rolling the dice, using both his down rings and his opponent's up rings to complete the play, until he can no longer use both dice, either separately or in combined total.

Once the opponent's turn is over, player 1 takes all of his rings remaining in the up position out of the slide space, and places them over the corresponding raised numbers. This position is called the Safety Zone. Those rings are now safe from the opponent. A player may, if he wishes, move his own rings off the Safety Zone in order to keep his turn going.

In a longer version of the game, the method entails following all rules for the play outlined above, except for winning the game. Winning the game in the longer version entails having any rings resting in the vulnerable "up" position remain there, i.e. such rings must remain there through the duration of the opponent's turn. Should the opponent send any of those vulnerable rings back to the "down" position, the game continues. The moment a player succeeds in moving all ten rings to the home or safety position, and only then, he is declared the winner.

It thus will be seen that there is provided a method and article of manufacture which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. In a game with multiple choice strategy for a player and an opponent player having alternate turns to play, a method of manipulating playing pieces consisting of a first plurality of playing pieces and a second plurality of playing pieces, the number of playing pieces in said first and second pluralities of playing pieces being equal, said first plurality of playing pieces relating to said player, and second plurality of playing pieces relating to said opponent player, each of said playing pieces in said first and second plurality of playing pieces relating to a distinct identifying symbol, the identifying symbol of each of said first plurality of playing pieces being the same as the identifying symbol of one of said second plurality of playing pieces, which comprises disposing each of said playing pieces at a location separate from the location of the balance of said playing pieces, said location for each playing piece being either a start position, a vulnerable intermediate position to which the playing piece has been moved from said start position, or a non-vulnerable finish position to which the playing piece has been moved from said intermediate position, said player and said opponent player in alternate turn concomitantly manipulating a plurality of discrete identification means bearing identifying symbols, a first manipulation of said plurality of identification means being by said player and a second manipulation of said plurality of identification means being by said opponent player, each of said manipulation registering a plurality of said identifying symbols, said first player displacing, after said first manipulation of said plurality of identification means, and in correspondence to the symbols registered either on each or the combination of at least two identification means, at least one of said first plurality of playing pieces either from its start position or its finish position to its intermediate position, or at least one of said second plurality of playing pieces from its intermediate position to its start position, said player continuing his turn and manipulating said plurality of identification means until movement of a playing piece corresponding to each separate one or the combination of a plurality of registered identifying symbols is no longer possible, thereafter said opponent player moving all of said second plurality of playing pieces in intermediate position to finish position, thereafter said second player displacing, after said second manipulation of said plurality of identification means, and in correspondence to the symbols thereafter registered on each or the combination of at least two identification means, at least one of said second plurality of playing pieces either from its start position or its finish position to its intermediate position, or at least one of said first plurality of playing pieces from its intermediate position to its start position, said opponent player continuing his turn and manipulating said plurality of identification means until movement of a playing piece corresponding to each separate one or the combination of a plurality of registered identifying symbols is no longer possible, thereafter said player moving all of said first plurality of playing pieces in intermediate position to finish position, and continuing manipulation of said plurality of identification means alternately by said player and said opponent player until either said first plurality of playing pieces or said second plurality of playing pieces is entirely disposed away from their start position.

2. The method in the game of claim 1 in which the final disposition of the first or second plurality of playing pieces which is away from starting position is a portion in intermediate position and the balance in finish position.

3. The method in the game of claim 1 in which the final disposition of the first or second plurality of playing pieces which is away from starting position is entirely in finish position.

4. The method in the game of claim 1 in which the game is initiated with all of said playing pieces in start position.

5. The method in the game of claim 1 in which the game is initiated with all of said playing pieces in intermediate position.

6. The method in the game of claim 1 in which each identifying symbol is a number.

7. The method in the game of claim 6 in which the number of playing pieces in each of the first and second plurality of playing pieces is ten, and the distinct identifying symbol for each playing piece is a number from one to ten.

8. The method in the game of claim 7 in which the plurality of identification means is a plurality of dice.

9. The method in the game of claim 1 in which each identifying symbol is a letter.

10. The method in the game of claim 1 in which each identifying symbol is a color.

11. The method in the game of claim 1 in which each identifying symbol is a visual reproduction of a plant or animal.

12. The method in the game of claim 1 in which the plurality of identification means is a plurality of regular polyhedrons, each face of each polyhedron bearing a different one of the identifying symbols.

13. The method in the game of claim 1 in which the number of identification means is two.

14. An article of manufacture consisting essentially of a game with multiple choice strategy for a player and an opponent player having alternate turns to play, comprising a flat planar playing board, a first plurality of linear channels on said board, a second plurality of linear channels on said board, said first and second plurality of channels consisting essentially of discrete slide spaces on the surface of said board, said first plurality of channels being juxtaposed in parallel substantially perpendicular to a first edge of said board, said second plurality of channels being juxtaposed in parallel substantially perpendicular to a second edge of said board, said second edge being opposite to said first edge, a first plurality of discrete means on said board, said first plurality of discrete means designating first finish positions, each of said first plurality of discrete means being on the surface of said board and juxtaposed with the inner end of one of said first plurality of channels, a second plurality of discrete means on said board, said second plurality of discrete means designating second finish positions, each of said second plurality of discrete means being on the surface of said board and juxtaposed with the inner end of one of said second plurality of channels, a plurality of distinct identifying symbols, each of said symbols relating to one of said channels and its associated discrete means, the identifying symbol of each of said first plurality of channels and discrete means being the same as the identifying symbol of one of said second plurality of channels and discrete means, a plurality of movable playing pieces, each playing piece being associated with one of said channels and associated discrete means, each playing piece being disposed either at one end of a channel or at its associated discrete means, and a plurality of discrete identification means bearing identifying symbols and capable of being manipulated.

15. The article of manufacture of claim 14 in which the playing board is substantially rectangular.

16. The article or manufacture of claim 15 in which the playing board is square.

17. The article of manufacture of claim 14 in which the linear channels are slots formed as linear depressions below the surface of the playing board.

18. The article of manufacture of claim 14 in which each discrete means of the first and second plurality of discrete means is a raised protuberance above the surface of the playing board.

19. The article of manufacture of claim 18 in which each playing piece is provided with a recess which mates with a raised protuberance when the playing piece is disposed on the discrete means.

20. The article of manufacture of claim 19 in which the recess and the raised protuberance are circular.

21. The article of manufacture of claim 14 in which each of the distinct identifying symbols appears on one of the discrete means.

22. The article of manufacture of claim 14 in which each playing piece is substantially disc-shaped.

23. The article of manufacture of claim 22 in which the linear channels are provided with rounded ends.

24. The article of manufacture of claim 23 in which the linear channels are slots formed as linear depressions below the surface of the playing board.

25. The article of manufacture of claim 14 in which an area for random movement of the discrete identification means is provided on the surface of the playing board, said area being spaced between said first plurality of linear channels and said second plurality of linear channels.

26. The article of manufacture of claim 25 in which the area is centrally disposed on said playing board.

27. The article of manufacture of claim 26 in which the area is a central recess in the surface of the playing board.

28. The article of manufacture of claim 14 in which each distinct identifying symbol is a number.

29. The article of manufacture of claim 28 in which the number of linear channels and associated discrete means in each plurality of linear channels and associated discrete means is ten, and the distinct identifying symbols are numbers from one to ten, each one of said numbers for each one of the first or second plurality of linear channels and associated discrete means differing from the balance of the numbers.

30. The article of manufacture of claim 29 in which the plurality of discrete identification means are dice.

31. The article of manufacture of claim 30 in which the number of dice is two.

32. The article of manufacture of claim 14 in which the number of discrete information means is two.

33. The article of manufacture of claim 14 in which the plurality of discrete identification means are regular polyhedrons, each face of each polyhedron bearing a different one of the identifying symbols.

34. The article of manufacture of claim 33 in which the number of regular polyhedrons is two.

35. The article of manufacture of claim 14 in which the linear channels each are of straight line form.

* * * * *